US011434614B1

(12) United States Patent
Prabhune

(10) Patent No.: US 11,434,614 B1
(45) Date of Patent: Sep. 6, 2022

(54) CARTRIDGE-BASED POOPER-SCOOPER

(71) Applicant: Ravi Prabhune, San Jose, CA (US)

(72) Inventor: Ravi Prabhune, San Jose, CA (US)

( * ) Notice: Subject to any disclaimer, the term of this patent is extended or adjusted under 35 U.S.C. 154(b) by 0 days.

(21) Appl. No.: 17/670,695

(22) Filed: Feb. 14, 2022

(51) Int. Cl.
*E01H 1/12* (2006.01)

(52) U.S. Cl.
CPC ... *E01H 1/1206* (2013.01); *E01H 2001/1233* (2013.01)

(58) Field of Classification Search
CPC ..... E01H 1/206; E01H 2001/1233; E01H 2001/126
USPC ..... 294/1.3
See application file for complete search history.

(56) References Cited

U.S. PATENT DOCUMENTS 3,446,525 A 5/1969 Jones
3,718,358 A * 2/1973 Ayers ..... A47L 13/52 294/1.4
4,286,816 A * 9/1981 Tobias ..... E01H 1/1206 294/1.4
4,422,681 A * 12/1983 Laroche ..... E01H 1/1206 294/1.4
4,466,648 A * 8/1984 Albiez ..... E01H 1/1206 294/1.4
7,374,215 B2 5/2008 Anderson
8,002,319 B1 8/2011 Hahn
8,292,338 B1 * 10/2012 Baghdasaryan ..... E01H 1/1206 294/1.3
9,970,168 B2 * 5/2018 Krause ..... E01H 1/1206
2013/0269622 A1 * 10/2013 Charette ..... A01K 1/0114 294/1.3

FOREIGN PATENT DOCUMENTS

DE 3614936 A1 * 11/1986
FR 2810683 A1 * 12/2001 ..... E01H 1/1206

* cited by examiner

*Primary Examiner* — Dean J Kramer
(74) *Attorney, Agent, or Firm* — Foundation Patents, LLP; Richard Bennett Salles

(57) ABSTRACT

A pooper scooper waste removal device comprising shell pieces with magnets and matching metal strips for removably housing an interior cartridge with a lid piece having an arrow-shaped locking tab and an interior cartridge base piece having a slot for receiving the tab and a plurality of parallel sticks for engaging the animal waste to be removed, such that the cartridge lid piece and the cartridge base piece are easily tab-locked to form a single disposable poop-filled cartridge box to be discarded, such that new interior cartridge pieces may then be loaded into the shell pieces for future waste removal.

18 Claims, 13 Drawing Sheets

| | | | |
|---|---|---|---|
| Cartridge Lid | Outside Length | 86 mm |  |
| | Outside Width | 81 mm |  |
| | Outside Height | 11 mm |  |
| | Thickness | 1 mm | Thickness of material |

| | | | |
|---|---|---|---|
| Cartridge Base | Outside Length | 86 mm |  |
| | Outside Width | 86 mm |  |
| | Outside Height | 18 mm |  |
| | Thickness | 1 mm | The thickness of the chipboard/material |

| | | | |
|---|---|---|---|
| Male Notch (Arrow) i.e. Lock Lip | Arrow Tip Angle | 136° | |
| | Arrow Side Angle | 45° | |

FIG. 8

| | | | |
|---|---|---|---|
| Cartridge Base | Inside Height | 17 mm |  |
| | Protrusion Length (from Outside Edge) | 11 mm |  |
| Female Slot for Arrow i.e. Lock Slot | Length | 28 mm |  |

| | | | |
|---|---|---|---|
| Cartridge Base | Stick Hole Diameter | 2 mm |  |
| | Distance Between the Centers of Stick Holes | 8 mm | |
| | Inside Length | 84 mm |  |
| | Inside Width | 84 mm |  |

| | | | |
|---|---|---|---|
| Cavities to hold Metal Strips | Length | 35.56 mm |  |
| | Width | 12.914 mm | |
| | Depth | 1 mm |  |
| Metal Strip | Dimensions (LxWxH) | 35x12x1 mm | |
| Holder Guide Cavity | Diameter | 5 mm |  |
| | Depth (hemispherical, so ½ of diameter i.e. radius) | 2.5 mm |  |

| | | | |
|---|---|---|---|
| Guide Post (in Base Holder and Lid Holder) | Angle of Depression (Slope for the Top Face) | 45° | |
| Cartridge Retainer (in Base Holder and Lid Holder) | Width Offset | 2 mm | |

FIG. 12

| | | | |
|---|---|---|---|
| Cartridge Retainer (in Base Holder and Lid Holder) | Inner Height | 6 mm |  |
| | Outer Height | 8 mm |  |
| | Angle of Depression (Slope for the Top Face) | 45° |  |

CARTRIDGE-BASED POOPER-SCOOPER

This application claims priority to no U.S. Provisional Applications.

TECHNICAL FIELD OF THE DISCLOSURE

This application relates to the field of pooper scoopers.

BACKGROUND OF THE DISCLOSURE

A pooper-scooper, or poop scoop, is a device used to pick up animal feces from public places and yards, particularly those of dogs. Pooper-scooper devices often have a bag or bag attachment. 'Poop bags' are alternatives to pooper scoopers, and are simply a bag, usually turned inside out, to carry the feces to a proper disposal area.

Many inventors have tried to solve the "avoid touching the poop" problem, along with the separate problem of utilizing a convenient disposable biodegradable poop-container, with plastic or cornstarch bags that slip inside or around a dustpan-style vessel substantially attached to a stick-with-handle.

While the positioning of these bags varies, their idea remains similar: a flimsy bag which the dog owner must physically/manually pull away from the shell-vessel, then synch or tie the bag, then discard, then load another clean/empty bag into the device.

In these cases, the flimsiness of the bag, along with the requirement to pull the bag from the vessel, customarily leaves the dog owner with a great chance of smearing poop on their hands, not to mention the distasteful process of holding a flimsy poop-filled bag until a garbage can is found.

Other inventors have tried to solve the problem by eliminating the stick+vessel component, and simply providing a form-fitting poop container with a large-mouth aperture, like a cardboard container of McDonalds® French fries. In these cases, the invention requires the dog owner to reach down and push the poop into the container with a makeshift implement, then hold the container+poop until a garbage is found. Obviously, this system does not solve the key issues.

What is needed is a system that efficiently grabs all the poop without touching the dog owner's hands, then allows the owner to subsequently reach a garbage can with minimal exposure to the poop, then eject a biodegradable replaceable "cartridge" which the owner can later replace and reload.

SUMMARY

The present invention is directed to a system and apparatus device for collecting dog poop (or other undesirable/smelly refuse) into a "base section" of a cardboard box cartridge, which is held in a base holder-shell piece. The system works by pressing this modular base piece atop/onto the dog poop on the ground, during which time the "base cartridge's parallel "sticks"" help collect and hold the poop). The dog owner then joins the poop-filled cartridge base to the cartridge lid (while each remains within their own shell to avoid poop-smearing). When the shell pieces are joined, the dog owner can push a finger through an aperture in the shell to join the inner-cartridge lid and base to form (via tab-into-slot locking mechanism) a single poop-filled cartridge box, ready for the trash (the cartridge box is also ejected from its shell via finger through shell aperture, to again avoid poop-smearing). Dog owner later re-loads a fresh cartridge (base and lid) inside their corresponding shell-holder pieces for the next dog walk.

BRIEF DESCRIPTION OF THE DRAWINGS

FIG. 8 illustrates an exploded view of one aspect of the "lid section" of the invention's internal poop cartridge, featuring the arrow-shaped notch tabs which engage the cartridge slots (not shown), as well as exemplary dimensions for one aspect of the invention.

FIG. 12 illustrates zoomed views of the shell base's guide post and cartridge retainers (side walls) in one aspect of the invention, as well as exemplary dimensions in one aspect of the invention.

DETAILED DESCRIPTION OF THE DRAWINGS

Figure 1:
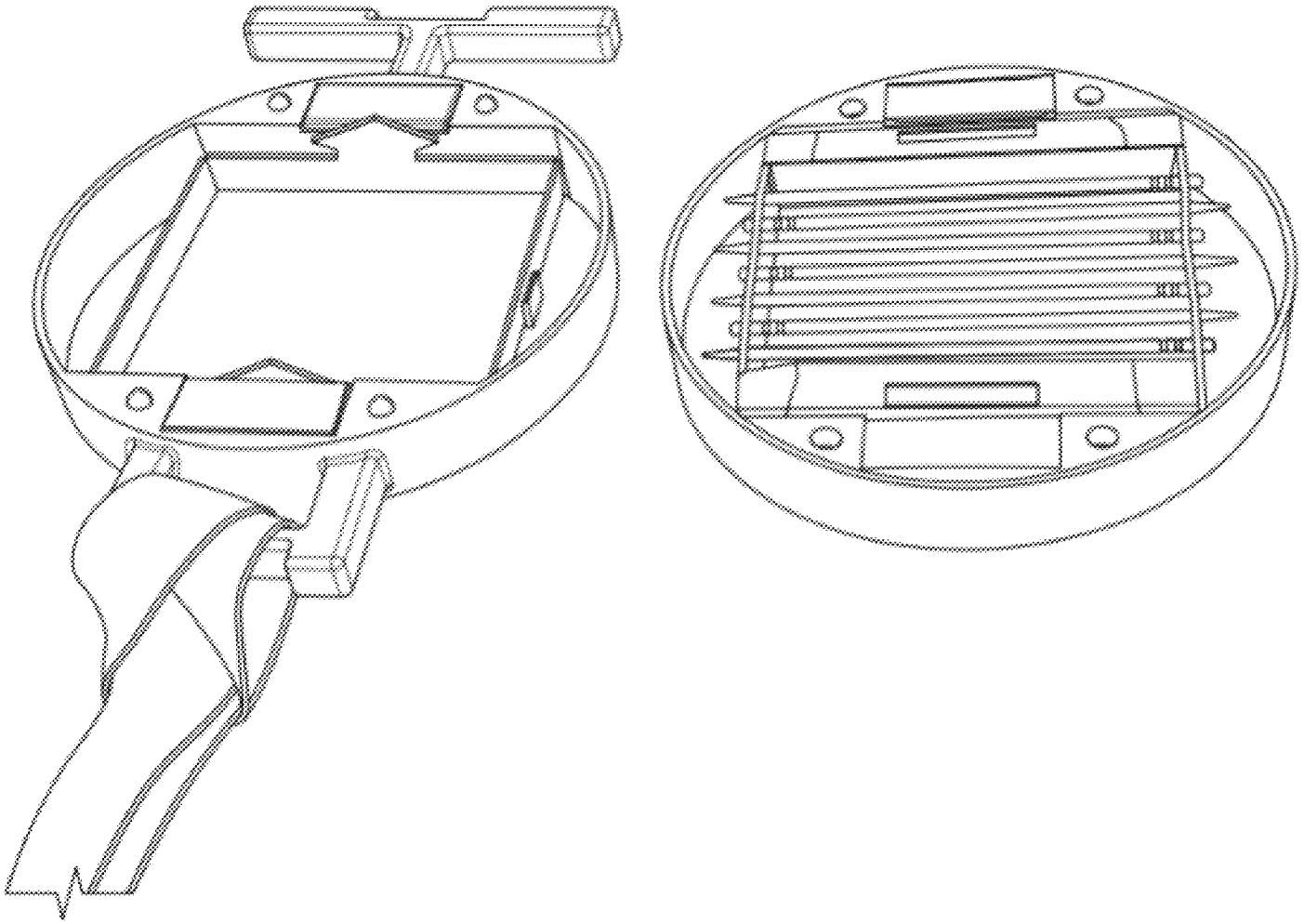
FIG. 1 illustrates a schematic overview of all relevant components of the present invention, "as assembled," with the shell parts separated to show internal components.

FIG. 1 illustrates a schematic overview of the majority of relevant components of the present invention "as assembled," with the two modular "shells" ["cartridge holders, or outer shells] separated to show internal components.

FIG. 1 Left Side

The left side of the drawing shows the cartridge lid loaded into its modular lid holder-shell. The height of Lid Holder (shell) is such that once cardboard Cartridge Lid piece is inserted into its shell, the tip of the Lock Lip (arrow shaped tab) on the Cartridge Lid is substantially flush with the inside edge of the Lid Holder (shell). This dimension/ratio is important since if the height of Lid Holder (shell) is too small, the tip may accidentally engage the Cartridge Base's slot and can result in unintentional locking (the tab lock system may engage prematurely).

The height (and therefore overall volume) of the Cartridge Lid piece is notably lower than that of Cartridge Base piece. The Cartridge Base's height can therefore be increased to intake bigger dog poop piles.

The Cartridge Lid height is sufficient to cover the poop that might stick out of the stick grid on Cartridge Base (when the lid is tab-locked with the base).

The Cartridge Lid is substantially rectangular and its dimensions are such that distance between the Lock Lip (arrow shaped tab) is slightly less (in one embodiment, about 4 mm less) than the distance between the outside edges of two Slots on the Cartridge Base.

This differential helps to ensure that each Lock Lip (arrow shaped tab) is properly aligned at the approximate center of its matching Slot when the shell is snapped shut to lock/assemble the two halves of the inner-cartridge (when the Cartridge Lid (the whole lid assembly on the left of the drawing) is placed over Cartridge Base (placed in the Base Holder shell and assembly)).

In one embodiment, the Cartridge Lid piece and Cartridge Base piece dimensions (length and width) are 0.5 mm less than corresponding dimensions of their matching Lid Holder and Base Holder. This differential ensures the cartridges fit easily & snuggly inside their holders (shells) but that they do not fall off until intentionally-ejected above a garbage can via user pressing-out the cartridge (separating the now-full cartridge box from its shell).

Optional drawn-indication-arrows (instructional lead lines shaped as arrows) may be printed on the inside of the Cartridge Lid and on the inside of the Lid Holder (shell) to indicate the alignment (to tell the user where to position the cartridge inside its shell) [as shown in FIG. 8]. Obviously, the same indicator(s) apply for Cartridge Base and Base Holder. (The optional indication line-arrows are guides to help users quickly place/position the Cartridge Lid and Cartridge Base into their respective Lid-&-Base Holders (shell pieces).

Holder Guides

The Lid Holder (shell) and Base Holder (shell) have small guides [male hemisphere guide-balls] which fit into hemisphere female hemisphere-shaped grooves/notches] to form an easily removable half "ball-socket joint" for guiding purposes only (positioning: one ball/joint positioned substantially at the end of each magnet/metal strip). These "holder guides" help users align the Lid Holder (shell) and Base Holder (shell) quickly.

Without these guides, it may become difficult for users to align Lid Holder (shell) and Base Holder (shell) as they are circular and it takes time and effort for users to find out the place where magnets/metals align.

Guiders are substantially half spherical balls on Lid Holder (shell) and half spherical cavities in Base Holder (shell).

In one embodiment, the Radius of balls in Lid Holder shell piece is 0.5 mm less than that of cavities in the Base Holder shell piece so that they are fully inserted in their respective cavities. This dimension ensures Lid Holder shell piece and Base Holder shell piece edges are in full contact, so there is no gap between the shells upon closure.

Appropriate alternative guiding mechanisms and guide shapes (e.g. conical) for one or all of the guides are also possible.

Sample Materials

Cartridges are comprised of chipboard (preferably biodegradable) (includes paper, molded pulp paper, paperboard, corrugated fiber board or cellulose fibers). Cartridges can also alternatively be made from other appropriate materials including biodegradable compostable cardboard.

Alternatively, environmental-hazard style plastics may be used, such as polystyrene, polyester, PVC, or foam sheets.

The two Modular Holders (shells) be made with 3D printing materials such as PLA plastic filament as well as other materials in production such as 'biodegradable' plastics, as well as steel, aluminum, composites, silicon, wood, and other appropriate "shell" materials so long as the shell material is sufficiently firm to removably hold the cartridges.

FIG. 1 Right Side: illustrates the invention's base holder (shell) and base cartridge piece (herein, the holder-shell is shown with its cartridge piece inserted into its shell piece).

The base shell has novel, substantially parallel poop-gathering sticks.

The base shell also comprises a fastening metal strip to engage with the lid shell's magnet (to removably hold to the lid-shell's magnet).

Obviously the magnet and its metal strip [ferromagnetic material strip such as iron, steel, nickel, cobalt or amalgam or other] may be interchanged between lid and base, and other appropriate substitutes for the invention's magnet-fastener system may be used, such as snaps, clasps, hooks, Velcro® or other appropriate fastening means).

The sticks in the Cartridge Base can be made out of birch wood or other materials (other woods, cardboard etc.)

Sticks may have pointed ends on one side and grooves on the other similar to toothpicks. These sticks are inserted in Cartridge Base in an alternate manner such that the stick with pointed end has a stick with groove end next to it.

In an alternative design/embodiment, the poop-gathering sticks may have pointed ends and grooves on both sides.

Sticks may be arranged from spacing perspective to cater to different variations in poop or material to be picked up. Spacing in sticks may be wider for denser materials for example based on texture or viscosity.

Stick cross section may also alternatively be cylindrical or triangular. Triangular sticks will have edges pointed outside the box. This can be helpful for holding the material up once it is inside Cartridge Base after it is picked up easily with the edge helping the stick to get into the material easily due to low friction.

Sticks may be comprised of milled birchwood, bushwood, bamboo, or any appropriate material.

Sticks are substantially cylindrical & are pointed at one end; with positioning grooves located on the other end.

If sticks are (alternatively) triangular, the pointy end should point out (toward the poop) for maximum penetration, then stick bases will best hold the poop inside.

Sticks are herein positioned alternately (for efficacy); As shown, the positioning avoids the need for glue. Sticks can also comprise full grooves or full points.

Currently, the distance between sticks is optimal for normal dog poop (its viscosity) (stick positioning & size spec. dimensions infra).

FIG. 2

Figure 2:
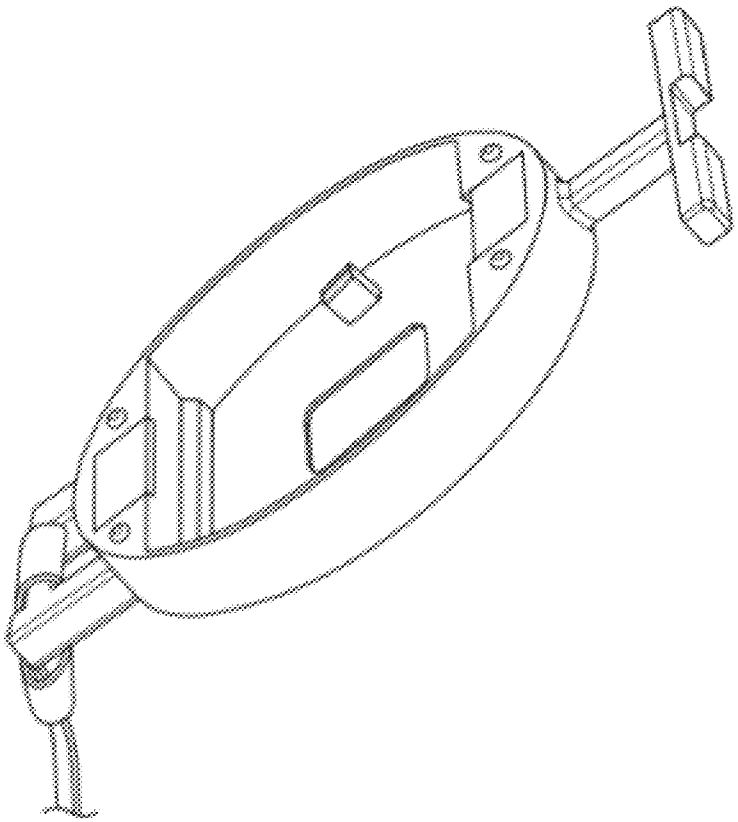
FIG. 2 illustrates the inside portions of invention's two-part modular shells.
Figure 2:
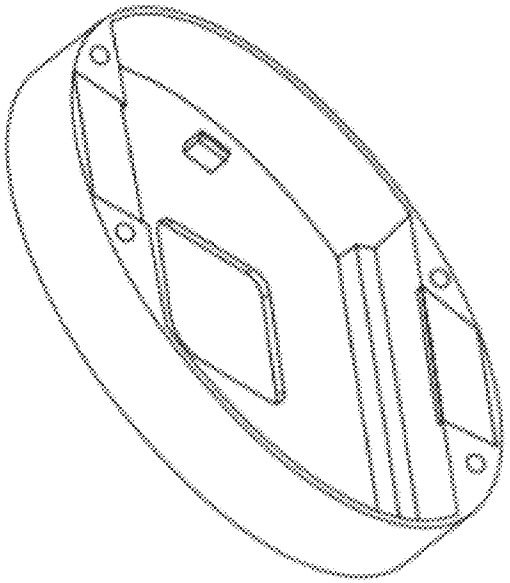

FIG. 2 illustrates/highlights the inside portions of invention's two-part modular Holders (cartridge-carrying shells).

Holders (Shells) Design

Friction for holding the Cartridges: substantially aided by Cartridge Retainers (shell's stepped/grooved angled sidewalls which aid friction to temporarily hold the weaker cardboard cartridges).

These Retainers (shell inner sidewalls) help the mechanism keep insertion [hold the cartridges] and & allow for easy ejection of cartridge(s) when user desires. Therefore, Lid Holder (shell) and Base Holder (shell piece) have Cartridge Retainers that run substantially along the same axis as the magnets. The Cartridge Retainers (stepped sidewalls) are at the bottom of the Holders (shells) and have a relatively small height (their "step" portion is relatively small, running along the bottom of the shell to engage & temporarily hold the cartridge). The Retainer (step) height is preferably about 20 to 25% of the overall height of Cartridge Lid; likewise, about 20-25% the height of the Cartridge Base.

Excessive retainer height (holding step height) causes higher friction (and obstruction) during insertion and ejection, impeding the ease of use.

Less retainer height causes the cartridge/box pieces gives the cartridge boxes too much wiggle room inside the shells. Most notably, if retainer is too small, Cartridge Base may fall off when the user turns Base Holder (with Cartridge Base inside) upside down.

Preferably, at the 20-25% shell height ratio, the friction force between the Cartridge Retainer and side of Cartridge Base keeps the cartridge snuggly fit inside the Base Holder for optimum use.

Base Holder/Shell's Circular shape: It is important that Base Holder (shell piece) is substantially circular in shape or has adequate space (not necessarily circular) on the sides where Cartridge Base, once inserted, has stick ends protruding out of the cartridge and this design ensures Cartridge Base fits easily inside Base Holder. In short, no poop should stick to the sidewalls of the base holder shell piece.

Further Cartridge Retainer (Stepped/Sloped" Inner Shell Sidewall Bases) Spec's:

Each slanted edge does not go all the way to the bottom of the holder.

Instead, the slanted edge (i.e. the slope ends) after some drop (between about 2 mm to 3 mm drop) and then the remainder of the upper shell wall becomes vertical for the friction benefits noted above (the retainer, the design, and the guide posts give the shell/holders the friction and positioning needed to removably hold their respective cartridge pieces).

Guide posts (the small, substantially rectangular guide posting tabs that protrude upward from the base of the inner shells)

Lid Holder (shell piece) and Base Holder (shell piece) each have two small Guide Posts. The width of these posts is relatively small (i.e. these are not running along the entire length of the holders to minimize friction during insertion and ejection, but rather act as positioning tabs).

The Posts have slanted top edges (slanted top surfaces) for easy cartridge-insertion and cartridge-ejection. The Guide Posts in the Base Holder have height sufficient to provide adequate friction to hold the Cartridge Base, yet not too high to ensure that the height does not interfere with the ends of sticks protruding out of a Cartridge Base once it is inserted in the Base Holder. Height of Guide Posts for Lid Holder and Base Holder is between about 20% to 25% of the height of Cartridge Lid and Cartridge Base respectively.

In sum, the invention features "minimal sized guideposts" just high & wide enough to temporarily hold the cartridge base, while remaining below [not interfering with] the poop-gathering sticks.

Magnets (Ferromagnetic Fastening System for the Holder/Shell Lid & Base):

Lid Holder and Base Holder are held together using magnets and corresponding metal strips (such as metallic steel strips, or appropriate ferromagnetic materials, such as iron, steel, nickel, cobalt, etc.).

The invention's Magnets have sufficient magnetic field to hold the modular Lid Holder Shell piece and Base Holder Shell piece together (especially important when joined (as in FIG. 3) while the dog owner searches for a trash can), but weak enough for the dog owner to quickly pull these modular shell pieces apart.

Alternate design may use other mechanisms instead of or in addition to the magnets, e.g. clips, Velcro®, etc. (infra & supra).

Additionally, Note the base shell-holder piece (drawing's right side) comprises a T-shaped Handle for the dog owner to hold the unit while dog-walking, as well as a cleat for dog leash.

FIG. 3

Figure 3:
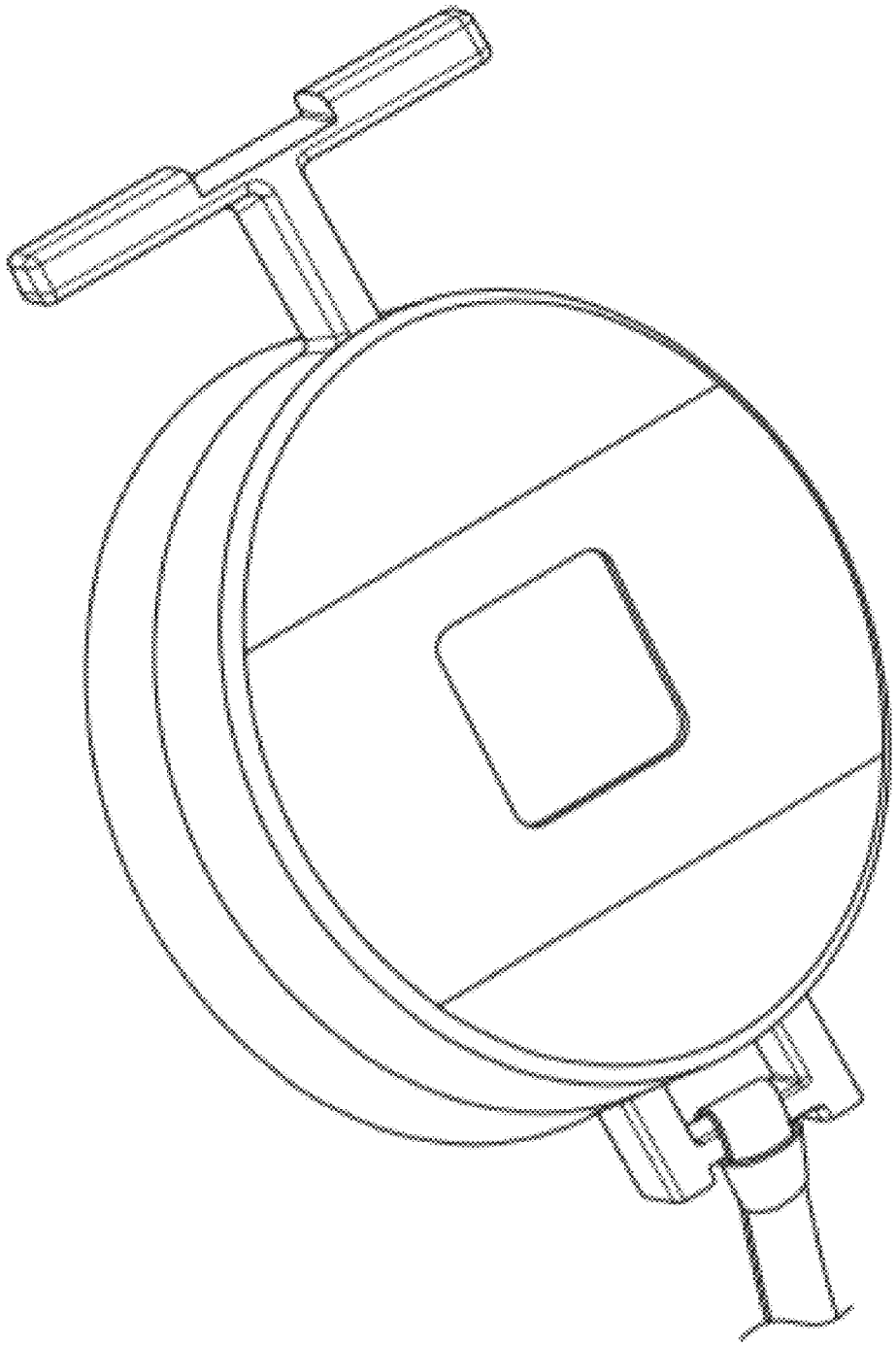
FIG. 3 illustrates the invention's shell "assembled and joined," featuring the leash-holder, the ejection aperture, and the user handle.

FIG. 3 illustrates the invention's holders/shells "assembled and joined," featuring the lid piece's leash-holder, the lid holder piece's central aperture [for the user to push & tab-lock the inner cartridge pieces).

FIG. 4

Figure 4:
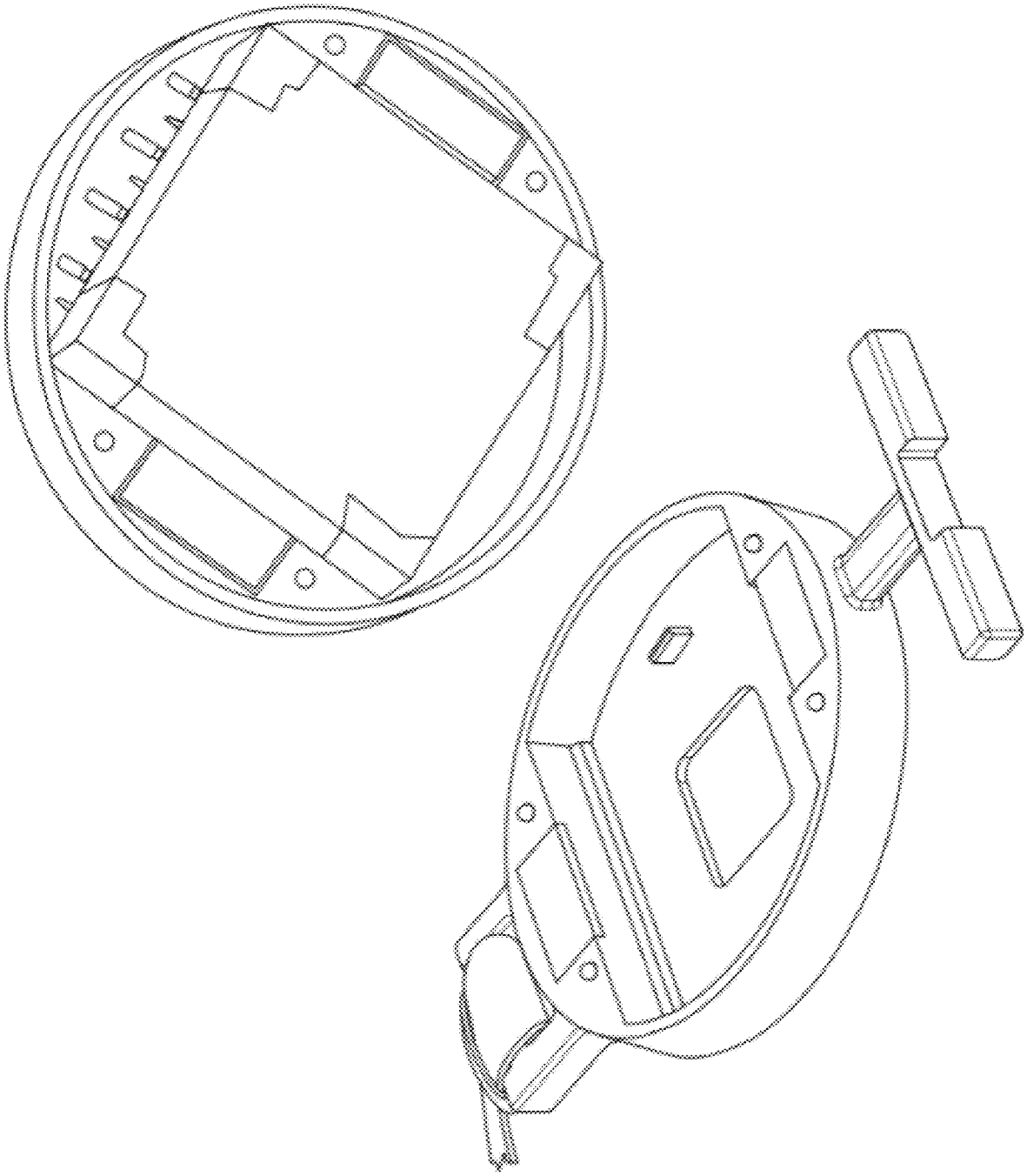
FIG. 4 illustrates the shell opened to reveal the "joined/locked" internal cartridge ready for ejection.

FIG. 4 illustrates the shell opened to reveal the internal cartridge pieces "joined/locked" as one cartridge box, ready for ejection. The figure illustrates how the base holder/shell piece still holds the cartridge for a moment (likely while suspended above a garbage can) while the dog owner prepares to put their finger through the base holder-shell aperture to eject the box-cartridge into the trash.

"Push to Lock" (Method to Disengage Cartridge from Holder-Shells for Expulsion)

While holder-shell pieces are joined as shown (while the unit assembly is filled with poop and the owner has found a garbage can), the Lid Holder shell piece features a (now rectangular) opening/aperture at the center of the metal holder/shell. The dog owner puts their finger through the aperture and pushes directly on the inner cardboard bottom of the substantially-concealed Cartridge Lid piece. This finger force "tab-locks" the cartridge lid&base together, making it into one disposable cardboard box.

Method: Pushing on the outside of the cartridge bottom piece causes the Cartridge Lid's Lock Lip (the arrow shaped tab) to slide into the Lock Slot in the Cartridge Base. (i.e. the arrow in the box top will engage the slot in the box bottom).

Upon full push, the Corners of the cartridge's Lock Lip (its arrow shaped tab) bend slightly to get through the slots to fully insert themselves through the slot. This process causes Cartridge Lid and Cartridge Base to be locked/joined as one box.

[In one embodiment], On the Cartridge Lid, the distance between Corners of the Lock Lip (the sides of arrow shaped tab) is slightly longer (between about 2 mm to about 4 mm) than the length of the Slot on Cartridge Base.

The dog owner's finger-pushing force is sufficient to push the Lock Lip (the arrow-shaped tab) through/into the slot, despite the slot's length being a bit smaller than the arrow's width. Once inside the slot, Lock Lip edges (the arrow-shaped tab's sides) cannot fall out of (disengage from) the slot.

In an alternative embodiment design, the Lid Holder Shell provides, e.g., two openings such that they are directly atop the inner cartridge Lock Lip (arrow shaped) Tabs. This alternative design helps communicate to users that a "push force" might be needed at both openings to join the inner-box. While the preferred embodiment shows this extra aperture is not currently necessary, consumers might want this in the future for a "double pop lock feeling," hence this alternative design is herein disclosed.

Final Step of FIG. 4 (Indicated but not Shown): Pushing Poop into Trash

With Lid Holder shell piece detached from Base Holder shell piece, The Base Holder shell piece (containing Cartridge Lid and Cartridge Base locked together as one poop-filled box), the user uses an opening at the center of Base Holder (similar to that on the lid holder for box-joining) to push out the Cartridge Base away from the Holder Shell. This force causes the now-poop-filled Cartridge Box to eject into trash. Obviously, upon returning home, the dog owner will likely wish to "recharge" or "refill" the base and lid shells with their corresponding (fresh) cartridge pieces.

Possible Accessories/Alternative Embodiments

There can be different attachments for various types of leashes, as the leash is now shown as-attached to a fixed external cleat affixed to the Holder Shell Top Piece, as shown in FIGS. 1-4. These leash attachments may be integral to the mechanism or may be fully detachable or a hybrid thereof.

There can be various alternative attachments to the outer holder-shell pieces, for storage or other purposes, e.g. for pet food, for water, for cleansing, for additional-secure-holding (such as a strap), or for a doggie dish or a food-treat.

For example, one alternate embodiments comprise a simple hand strap (or functional equivalent) positioned on the outside shell portion of the base holder piece, for the owner to briefly hold the base holder shell piece over a garbage can while they prepare to put their finger through the central aperture to eject the now poop-filled-unified-inner-cartridge.

Other alternative embodiments comprise various attachments for operating the mechanism (poop-pickup means) without requiring the dog owner to press the Cartridge onto the poop), such as mechanical vacuum suction means, chemical disincorporation means, or other "less manual" methodologies.

FIG. 5

Figure 5:
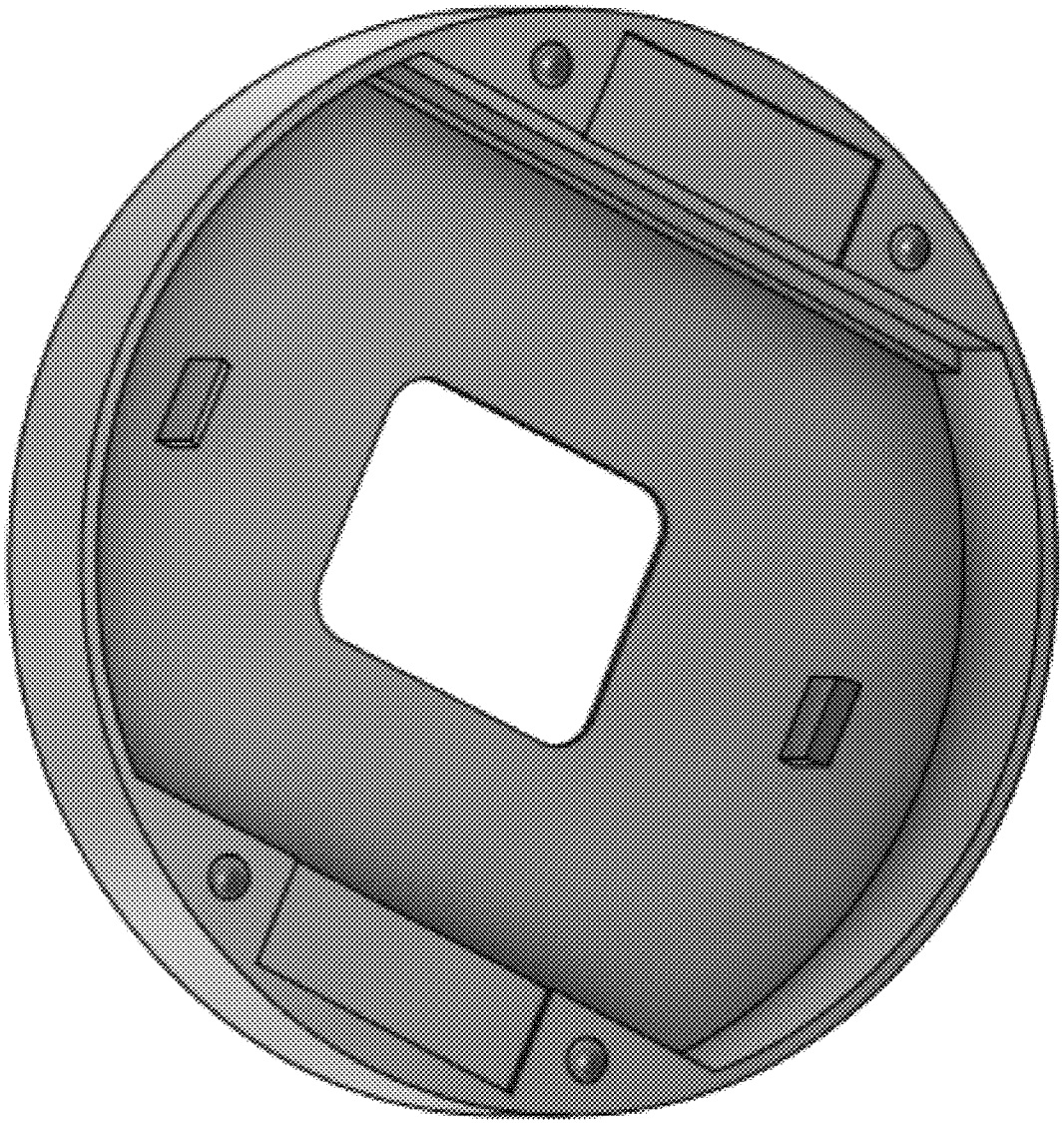
FIG. 5 illustrates one of the two modular shell components, illustrating the recessed-grooves for the magnet and ferrous-metal strip, as well as the guide posts for positioning the poop cartridge (not shown).

FIG. 5 features a CAD drawing of Holder-Shell Base Piece, featuring its central square-shaped aperture, the internal retainers (stepped edges), vertical guide posts, grooved-recesses for magnet & complementary strip, as well as featuring hemisphere guiders & groove-notches (the protrusions and matching cavities).

These hemisphere-shaped holder guides help the user quickly align (position) shell lid and shell base. They're shaped as hemispherical balls which go into hemisphere-shaped female cavity-grooves, with relatively high tolerance at the joining-point for easy detachment. (Note: guider shape may alternatively be conical [or other appropriate shape] if desired).

FIG. 6

Figure 6:
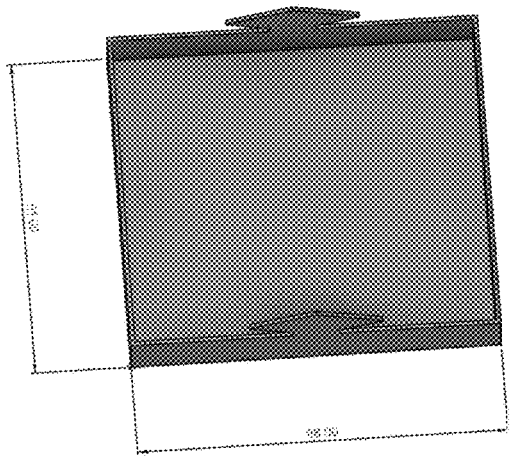
FIG. 6 illustrates one aspect of the invention's internal poop cartridge, featuring the arrow-shaped notch tabs which engage the cartridge slots (not shown), as well as exemplary dimensions for one aspect of the invention.
Figure 6:
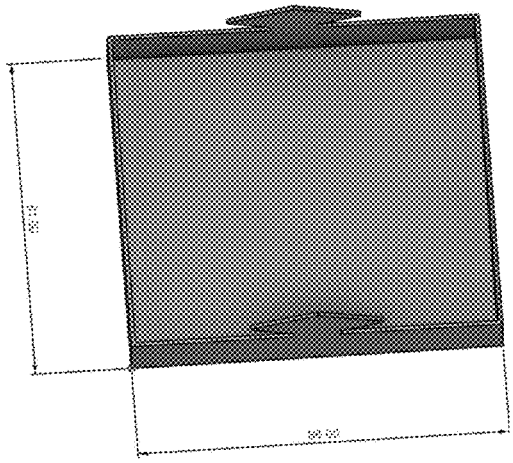
Figure 6:
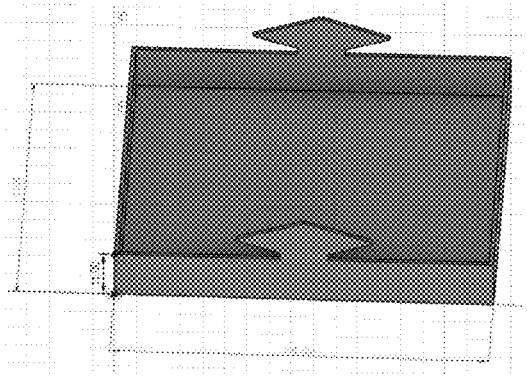

FIG. 6 features CAD drawing(s) of one embodiment's Cartridge Lid, indicating method of lid assembly, with exemplary dimension specifications (listed infra in "preferred embodiment.")

FIG. 7

Figure 7:
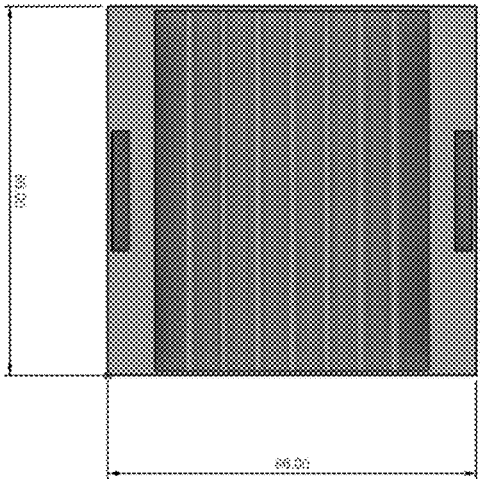
FIG. 7 illustrates one aspect of the invention's internal poop cartridge, featuring the cartridge locking slots which engage the cartridge arrows (not shown), as well as the positioning of the invention's poop-collecting sticks, as well as exemplary dimensions for one aspect of the invention.
Figure 7:
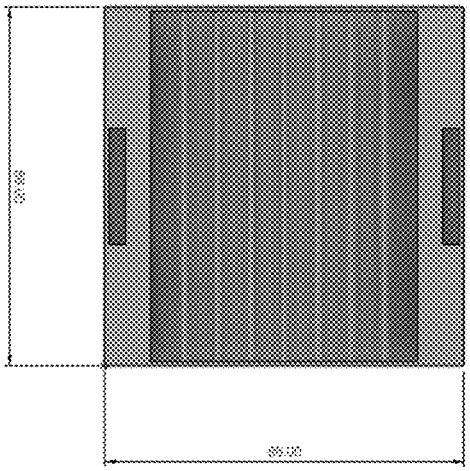
Figure 7:
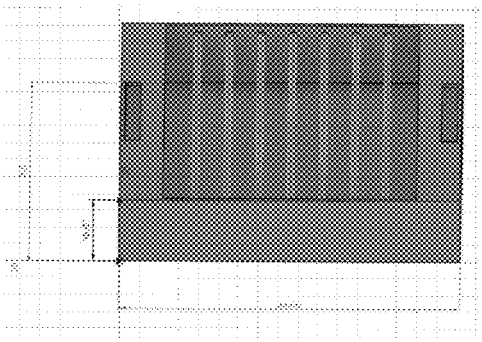

FIG. 7 features CAD drawing(s) of one embodiment's Cartridge Base, with indicated assembly method. FIG. 7 Drawing(s) feature poop-gathering sticks (herein shown vertically) and tab-lock slots (herein shown on sides).

Figure indicates exemplary specifications for one embodiment (listed infra in "preferred embodiment.")

FIG. 8

FIG. 8 features exploded-view CAD drawings of (one embodiment's) Cartridge Lid, featuring arrow-shaped notch tabs at the sides. FIG. 8 further comprises exemplary specifications (listed infra in "preferred embodiment.")

The FIG. 8 drawings feature the optional "arrow indicator #1" [herein shown vertically], showing the dog owner where to place the cartridge inside its holder-shell. (There is naturally a corresponding optional 'indicating arrow #2' for cartridge base-into-shell-base, as shown in FIG. 9).

Figure indicates exemplary specifications for one embodiment (listed infra in "preferred embodiment.")

FIG. 9

Figure 9:
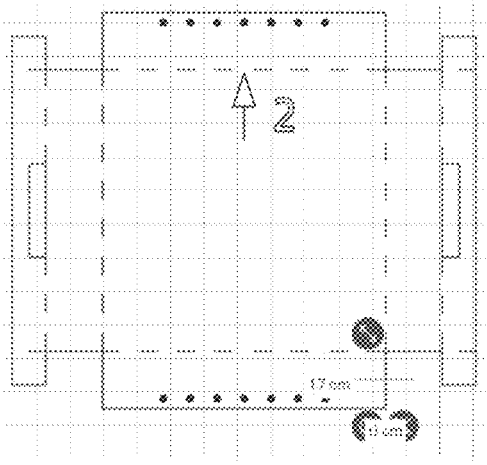
FIG. 9 illustrates an exploded and top view of one aspect of the invention's internal poop cartridge, featuring the cartridge locking slots which engage the cartridge arrows (not shown), as well as the positioning of the invention's poop-collecting sticks, as well as exemplary dimensions for one aspect of the invention.
Figure 9:
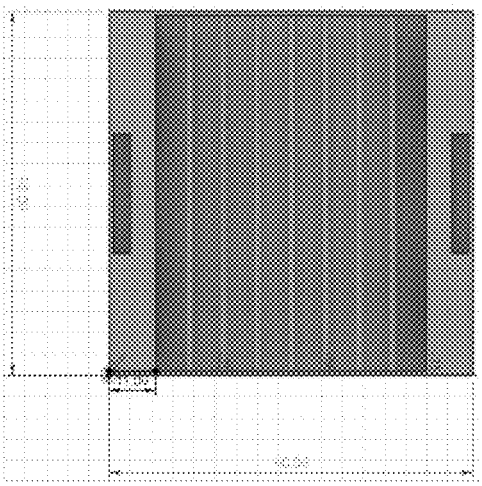
Figure 9:
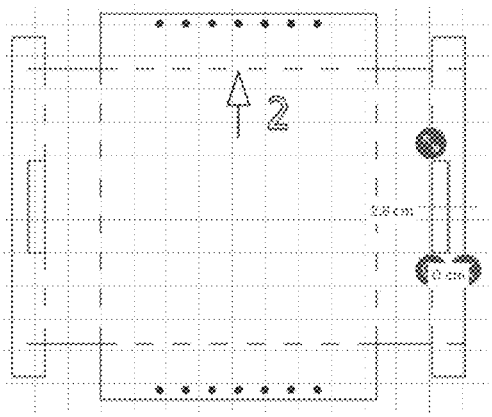

FIG. 9 features CAD drawings of one embodiment's Cartridge Base, indicating assembly method, and also featuring optional 'indicating arrow #2' for dog owner cartridge-entry-positioning. FIG. 9 also features exemplary stick and stick-hole spacing.

FIG. 9 further comprises exemplary dimensions & specifications (listed infra in "preferred embodiment.")

FIG. 10

Figure 10:
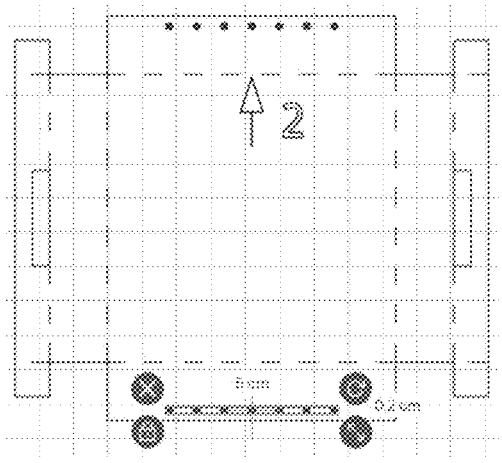
FIG. 10 illustrates an exploded top view of one aspect of the invention's internal poop cartridge, featuring the cartridge locking slots which engage the cartridge arrows (not shown), as well as the positioning of the invention's poop-collecting sticks, as well as exemplary dimensions for one aspect of the invention.
Figure 10:
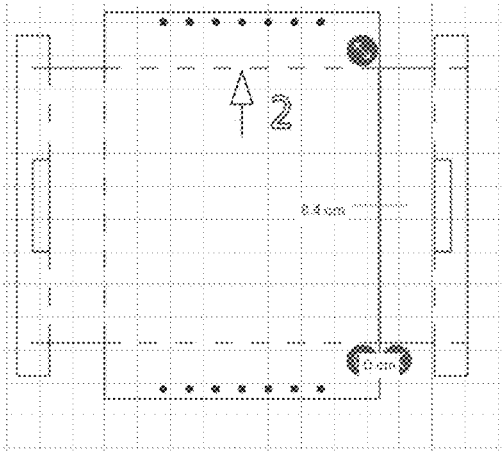
Figure 10:
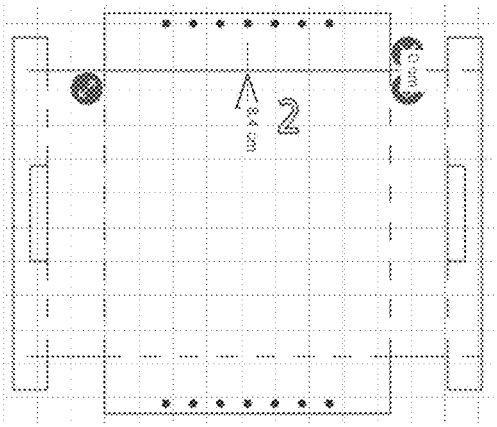

FIG. 10 features CAD drawings of one embodiment's Cartridge Base, indicating assembly method, and also featuring optional 'indicating arrow #2' for dog owner cartridge-entry-positioning. FIG. 9 also features exemplary stick and stick-hole spacing.

FIG. 10 further comprises exemplary dimensions & specifications (listed infra in "preferred embodiment.")

FIG. 11

Figure 11:
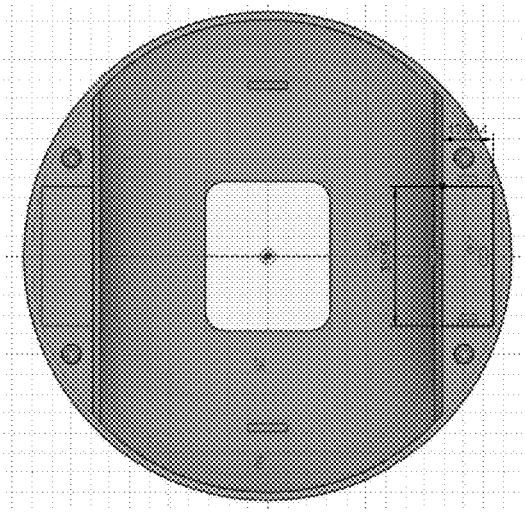
FIG. 11 illustrates perspective elevational views of the shell base's guide post and cartridge retainers (side walls) in one aspect of the invention, as well as exemplary dimensions in one aspect of the invention.
Figure 11:
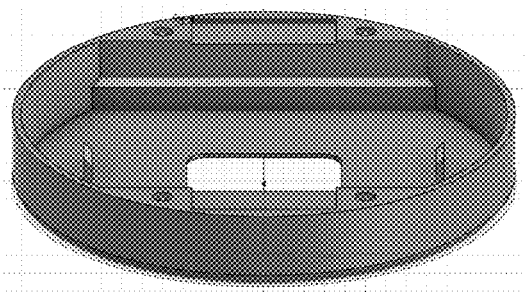
Figure 11:
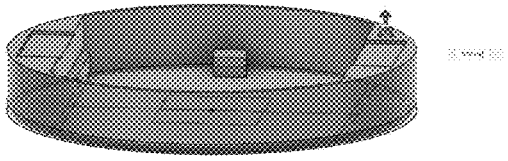
Figure 11:
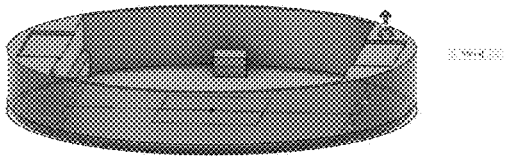

FIG. 11 features CAD drawing(s) of Holder-Shell Base Piece, featuring its central square-shaped aperture, the internal retainers (stepped edges for cartridge retention), vertical guide posts with slanted tops, grooved-recesses for magnet & complementary strip, as well as featuring hemisphere guiders & hemisphere groove-notches (the protrusions and matching cavities).

These small hemisphere-shaped holder guides help the user quickly align (position) shell lid and shell base. They're shaped as hemispherical balls which go into hemisphere-shaped female cavity-grooves, with relatively low tolerances (herein relatively loose fit) at the joining-point for easy detachment. (Note: guider shape may alternatively be conical [or other appropriate shape] if desired).

FIG. 11 further comprises exemplary dimensions & specifications (listed infra in "preferred embodiment.")

FIG. 12

FIG. 12 features CAD drawing(s) of Holder-Shell Base Piece, featuring its internal retainers (stepped angled edges for cartridge retention), as well as vertical guide posts with slanted tops (also for temporary cartridge retention).

FIG. 12 further comprises exemplary dimensions & specifications (listed infra in "preferred embodiment.")

FIG. 13

Figure 13:
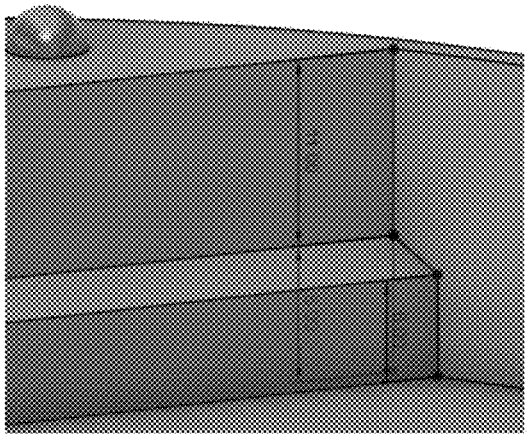
FIG. 13 illustrates a perspective elevational zoomed view of the invention's shell base cartridge retainers (side walls) in one aspect of the invention, as well as exemplary dimensions in one aspect of the invention.
Figure 13:
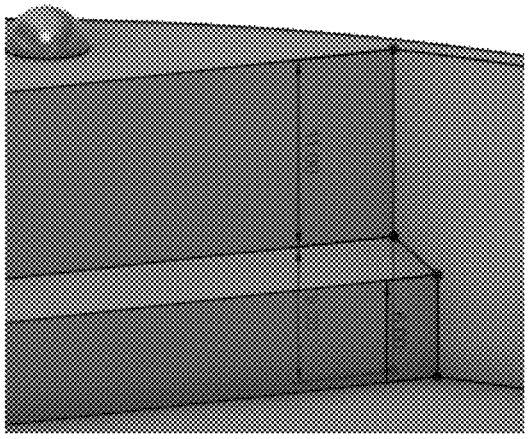
Figure 13:
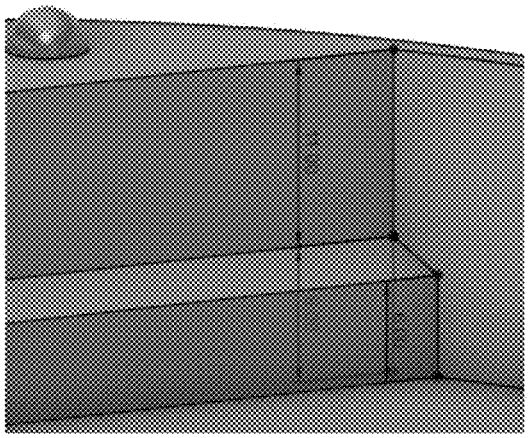

FIG. 13 features zoomed CAD drawing(s) of Holder-Shell Base Piece's internal retainers (stepped angled edges for cartridge retention), as well as hemisphere guiders atop the shell-holder's face.

FIG. 13 comprises exemplary dimensions & specifications (listed infra in "preferred embodiment.")

One Preferred Embodiment

Base Holder Shell Piece

Inner diameter: 120.2 mm

Outer diameter of shell: 124.2 mm

Metal strip: 35 mm×12 mm×1 mm (inside a 2 mm depth cavity)

Distance between retainer cartridges: 80 mm

Guide posts for cartridges: 10 mm high (sloped to 6 mm) by 2 mm width (45° sloped top)

Cartridge retainer cavity lip [width offset]=2 mm (sloped at 45° for top face)

Cartridge base: 86 mm×86 mm×18 mm height×1 mm thick

Cartridge lid: 86 mm×81 mm×11 mm height×1 mm thick

Arrow notch to lock lid: 32 mm full length (bendable) into 28 mm slot

Arrow angles; tip 136°; side angles to grab sides of slot=45°

Stick holes 2 mm diameter set 8 mm apart

Feces box (cartridge) base: 84 mm×84 mm×17 mm height

Note: cartridge lid is just barely taller than the holder/shell [almost flush with inner shell cavity height] so it does not accidentally engage with the cartridge base until the user wants to join the lid-&-base for ejection/discard.

Note:

Sticks are positioned alternately (for efficacy); Avoids need for glue. Can also be full grooves or full points.

Distance between sticks is optimal for normal dog poop (its viscosity).

Inventor's "Other Exemplary Specifications," Instant & Alterative Embodiments

Cartridge Lid and Cartridge Base dimensions (length and width) are 0.5 mm less than corresponding dimensions of Lid Holder and Base Holder. This ensures they fit easily/snuggly inside the holder, but do not fall off.

The mechanism may come in different sizes/radius to address needs of different pets and differing volumes of poop/material.

Cartridge Lid is rectangular and its dimensions are such that distance between the Lock Lip (arrow shaped tab) is slightly less (about 4 mm total less) than the distance between the outside edges of Lock Slots on the Cartridge Base. This helps to ensure that each Lock Lip (arrow shaped tab) gets aligned at the center of its Lock Slot when Cartridge Lid (placed in the Lid Holder) is placed over Cartridge Base (placed in the Base Holder).

Arrows printed on Cartridge Lid and Lid Holder indicate the alignment. Same applies for Cartridge Base and Base Holder. I.e. the arrows are mainly to guide users to properly and quickly place the Cartridge Lid and Cartridge Base into Lid Holder and Base Holder respectively.

current dimensions in the preferred embodiment are for smaller dogs. The dimensions may be scaled/larger to accommodate medium sized/larger dogs.

to facilitate multiple pickups in a walk, there may be plurality (in particular, two) of cartridge holders that could be snapped-in (depending on need/preference), such as: Two cartridge holders back to back and lids opening on the opposite sides (almost doubles the thickness when carrying). Two cartridge holders placed one above the other (increases the height when carrying).

Also, there could be a small plastic bag holder on the top (e.g. if a dog poops more than twice).

In order to avoid the faces/edge of Base Holder getting dirty during picking up, the height of the disposable Cartridge Base may be greater than that of the Base Holder, That way, only the face of the Cartridge Base touches the ground/poop and the sides of the Base Holder remain clean.

In this case, accordingly the height of Lid Holder would be greater than the Cartridge Lid, so that Cartridge Lid is placed on the Cartridge Base, they fit snuggly.

There can be different attachments for various types of leashes (width, length, retractable). These leash attachments may be integral to the mechanism or may be detachable.

There can be different attachments for storage e.g. pet food, water or dog toy.

There can be different attachments for operating the mechanism without needing a user to bend to pick up poop/material i.e. to press the Base Holder and Cartridge Base over the material and pickup.

Cartridges [lid piece and base piece] may be stackable and inserted as-such to discard one "complete box cartridge" and then another cartridge [sep. top and bottom in their respective shells] is already lining the inner-shell for another poop-pickup.

What is claimed is:

1. A poop-scooper comprising:

a handle;

a cleat for a dog leash;

a substantially rigid, modular outer two-part detachable shell piece, comprising a substantially central aperture on each detachable shell piece side;

a plurality of retainers for securely holding a disposable removable substantially-pliable inner cardboard poop cartridge piece that rests within the shell piece;

a plurality of guiders and grooved-recesses to hold the inner cartridge in place;

at least one magnet and at least one matching ferrous metal strip;

wherein the two-part detachable shell piece is substantially comprised of a first lid shell piece, which houses the removable pliable inner cartridge piece featuring at least one arrow shaped locking tab;

a second base shell piece, which houses the removable inner cartridge base piece, which comprises substantially parallel poop-gathering sticks and at least one slot to receive the cartridge lid's arrow shaped tab, such that when the shell lid and the shell base are aligned and joined, the inner cartridge lid and cartridge base pieces may be tab-locked by pushing the cartridge lid and cartridge base together by exerting force on the cartridge lid through the shell's aperture, therein pushing the cartridge lid's arrow tab into the cartridge base's slot, therein joining the inner cartridge lid and cartridge base to form a single poop-filled cartridge box by means of a tab-lock system such that the inner cartridge may be ejected by exerting force on the box through the shell base piece's central aperture.

2. The poop-scooper of claim 1 wherein each shell piece further comprises two cartridge-retainers that are substantially stepped-sidewalls which are shorter than the height of the shell, and wherein the tops of the stepped-sidewall retainers have a beveled angle to reduce cartridge friction so the internal cartridge may ultimately be removed.

3. The poop-scooper of claim 1 wherein each shell piece further comprises at least one guide post that is substantially a firm vertical inner rectangular tab that helps temporarily hold the cardboard poop cartridge, wherein the post has a beveled top for easy cartridge-removal.

4. The poop-scooper of claim 1 wherein each shell piece further comprises at least one hemisphere shaped guider and at least one matching hemisphere shaped groove such that, when the guider is positioned into the groove, the two shell pieces are easily joined and easily separated.

5. The poop-scooper of claim 1 wherein the cartridge pieces are comprised substantially of chip board.

6. The poop-scooper of claim 1, wherein the poop-gathering sticks are comprised substantially of birch wood.

7. The poop-scooper of claim 1 wherein the plurality of between 4 and 10 substantially parallel poop-gathering sticks rest in holes between about 1 mm to 3 mm in diameter, and wherein the sticks are set between 4 mm and 10 mm apart, and wherein each stick has a first pointy end and a second grooved end, and wherein the sticks are arranged alternatively "head to tail" for maximum poop-collection.

8. The poop-scooper of claim 1 wherein the cartridge lid's arrow tab is substantially bendable, and the arrow tab has a width slightly larger than that of its base slot, therein allowing the tab-lock system to remain fixed and keep the poop inside the tab-locked cartridge-box until ejection.

9. The poop-scooper of claim 1 wherein the cartridge lid piece comprises a printed number "one" with corresponding lead-line indicator, and wherein the cartridge base piece comprises a printed number "two" with corresponding lead-line indicator, each number corresponding to a similarly indicated position on the lid's shell and on the base's shell, to aid cartridge assembly/positioning.

10. A poop-scooper comprising:

a handle;

a cleat for a dog leash;

a shell piece attached to the handle, wherein the shell piece includes a plurality of grooved-recesses and at least one central aperture and at least one magnet and corresponding metal strip, wherein the shell piece further comprises a top, a bottom, and a first side, comprising:

a cartridge base piece comprising at least one slot, wherein the cartridge base piece is substantially a half-cardboard-box comprising a base and a top, wherein, fixed substantially-parallel poop-collecting toothpick-style poop-pickup sticks are positioned at the box top to form a grated lid;

a plurality of retainers for retaining the cartridge base piece within the shell piece;

at least one vertical guide post with a slanted top for positioning the cartridge base piece;

and then a second shell side, comprising:

a cartridge top, similarly shaped as a half cardboard box, comprising at least one tab to fit into the cartridge base's slot, such that the cartridge base and top pieces join to form a substantially square poop-filled inner cartridge box to be ejected by exerting force through the shell's aperture.

11. The poop-scooper of claim 10 wherein the shell's diameter is larger than the width/length of the substantially square cartridge, such that the poop-collecting sticks do not smear poop on the inside of the shell.

12. The poop-scooper of claim 10 wherein the shell further comprises at least one cartridge retainer running across at least one inside edge of the shell, wherein the retainer has a slanted edge whose width is smaller than the shell's diameter, such that the resulting friction between the retainer and the cartridge is sufficient to temporarily hold the cartridge but still sufficiently loose to allow ejection of the cartridge with relatively minimal force upon the cartridge through the shell's aperture.

13. The poop-scooper of claim 10, wherein the first shell side piece further comprises an optional strap attached to the handle.

14. The poop-scooper of claim 10, wherein the cartridge tab is substantially flexible and is slightly larger than its corresponding cartridge slot so the cartridge box does not accidentally open before removal.

15. A waste removal device comprising:

a substantially rigid, modular outer two-part detachable shell piece, wherein the shell piece itself comprises one lid side and one base side, further comprising a substantially central aperture on each side;

a plurality of retainers for securely holding a disposable cartridge piece within the shell piece;

a plurality of guiders and grooved-recesses; a magnet and matching ferrous metal strip;

wherein the two-part detachable shell piece is substantially comprised of a first lid shell piece, which houses a removable pliable inner cartridge lid piece featuring at least one substantially shaped arrow shaped locking tab;

a second base shell piece, which houses a removable semi-pliable inner cartridge base piece featuring substantially parallel poop-gathering sticks, and at least one slot to receive the cartridge lid's arrow shaped tab, such that when the shell lid and the shell base are aligned and joined, the inner cartridge lid and cartridge base pieces may be tab-locked by pushing the cartridge lid and cartridge base together by exerting force on the cartridge lid through the shell's aperture, therein pushing the cartridge lid's arrow tab into the cartridge base's slot, therein joining the inner cartridge lid and cartridge base to form a single poop-filled cartridge box, which may be ejected by exerting force on the box through the shell base piece's central aperture.

16. The device of claim 15 wherein the lid cartridge piece comprises at least one substantially arrow-shaped tab with a fixed width and the cartridge base piece comprises at least one slot slightly smaller than the width of the tab such that when the tab slides into the slot the cartridge becomes a single discardable box.

17. The device of claim 15 wherein the shell lid and the shell base each comprise printed indicators showing the proper position to place a new cartridge inside the shell.

18. The device of claim 15 wherein the substantially parallel poop-gathering pickup sticks are toothpicks.

* * * * *